US006760937B1

(12) United States Patent
Ou

(10) Patent No.: US 6,760,937 B1
(45) Date of Patent: Jul. 13, 2004

(54) PERSONAL CUSHION

(76) Inventor: Shu-Mei Chang Ou, No. 22, Lane 215, Shui-Yuan Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/458,317

(22) Filed: Jun. 11, 2003

(51) Int. Cl.[7] ..... A47G 9/00
(52) U.S. Cl. ..... 5/652.1; 5/641
(58) Field of Search ..... 5/652.1, 652, 724, 5/730, 736, 641, 944, 948, 951

(56) References Cited

U.S. PATENT DOCUMENTS 3,638,255 A * 2/1972 Sterrett ..... 5/641
4,508,775 A * 4/1985 Adiletta ..... 442/268
4,977,634 A * 12/1990 Koji ..... 5/638
5,706,535 A * 1/1998 Takashima ..... 5/485
5,918,333 A * 7/1999 Takashima ..... 5/641
6,151,733 A * 11/2000 Takashima ..... 5/636

FOREIGN PATENT DOCUMENTS

JP 403126454 A * 5/1991 ..... A61G/7/05

* cited by examiner

*Primary Examiner*—Robert G. Santos
(74) *Attorney, Agent, or Firm*—Troxell Law Office PLLC

(57) ABSTRACT

A personal cushion has a main body (100) with a bottom face and a covering layer (30) wrapped around the bottom face of the main body (100). The main body (100) is composed of a plastic layer (10) with multiple ventilating slots (11) and an intermediate layer (20) mounted under the plastic layer (10) by permeating liquid plastic molding material into the intermediate layer (20) when the plastic layer (10) is molded. Whereby, the personal cushion is easily manufactured and has a firm structure. The intermediate layer (20) has multiple fiber layers (21) and an active layer (23) containing ceramic powder or activated charcoal to provide ventilation, deodorizing and dehumidifying features in cooperation with the ventilating slots (11) in the plastic layer (10).

5 Claims, 5 Drawing Sheets

PERSONAL CUSHION

BACKGROUND OF THE INVENTION

1. Field of the Invention

The present invention relates to a personal cushion, and more particularly to a one-piece personal cushion that has multiple functions such as ventilation, cushioning, dehumidifying, deodorizing, anti-mite protection, shock-absorbing, etc.

2. Description of Related Art

Personal cushions are available in various configurations such as chair cushions, back cushions and stool cushions and directly contact the human body. Conventional personal cushions are available in the market and are composed of a cloth cover and stuffing material selected from artificial fiber, sponge filler, artificial filler and natural filler and fibers inside the cloth cover. However, the conventional personal cushion is often perpetually deformed after a period of use and easily becomes musty and soggy because the conventional personal cushion is not ventilated. Additionally, bacteria often grow on a musty and moist personal cushion, which causes the personal cushion to stink. Furthermore, dust mites nest and reproduce in the moist stuffing material and cause many people to have allergic reactions. Therefore, the conventional personal cushion needs to be ventilated better to make a person feel comfortable when using the personal cushion.

Moreover, the stuffing material cannot decompose after the conventional personal cushion is discarded and is burned to diminish the quantity of the waste stuffing material, which pollutes the air and causes more environmental problems.

The present invention has arisen to mitigate or obviate the disadvantages of the conventional personal cushion.

SUMMARY OF THE INVENTION

The main objective of the present invention is to provide an improved personal cushion that has excellent ventilation and most of the personal cushion will readily decompose to decrease environmental pollution.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
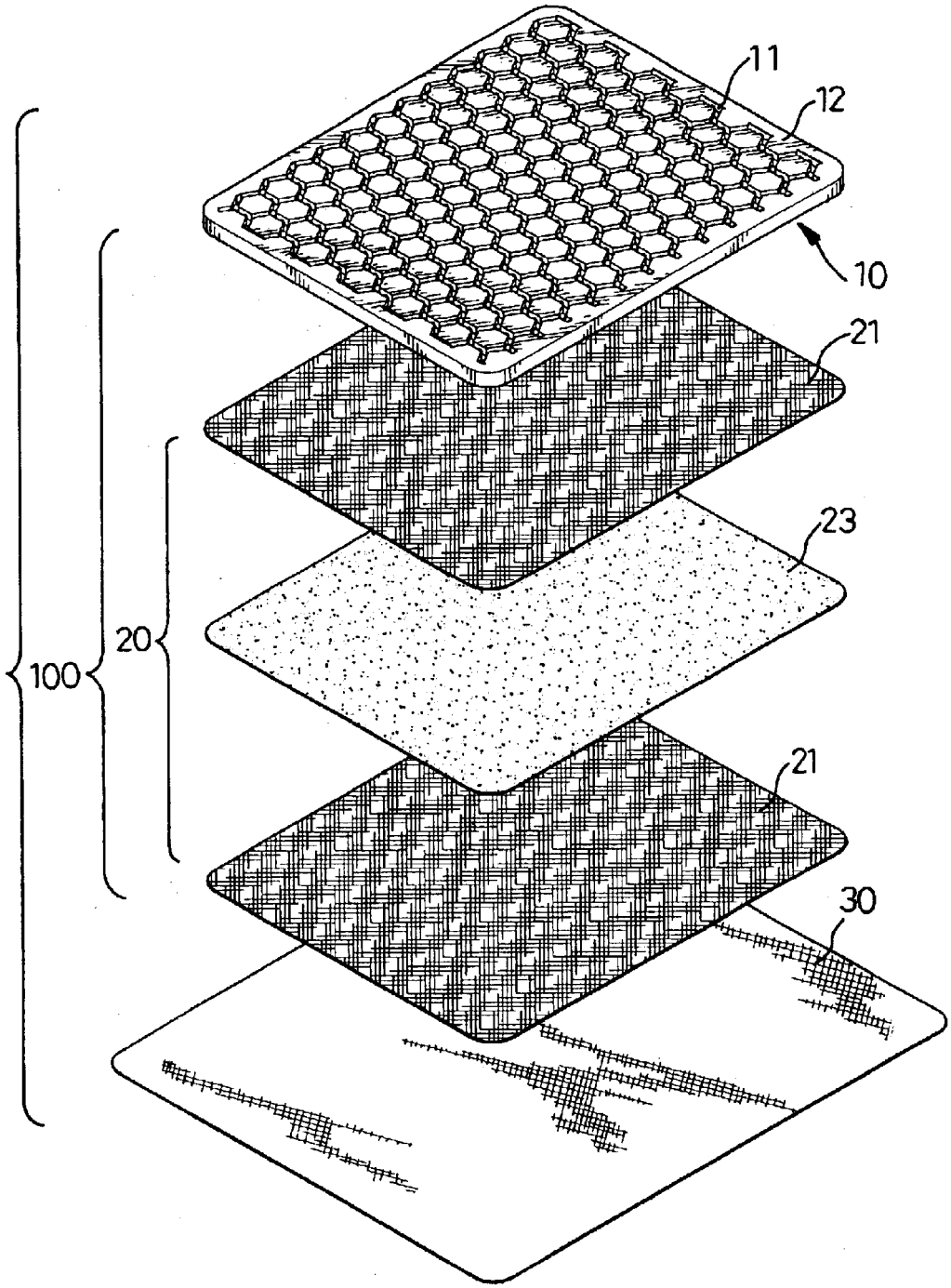
FIG. 1 is an exploded perspective view of a personal cushion in accordance with the present invention.
Figure 2:
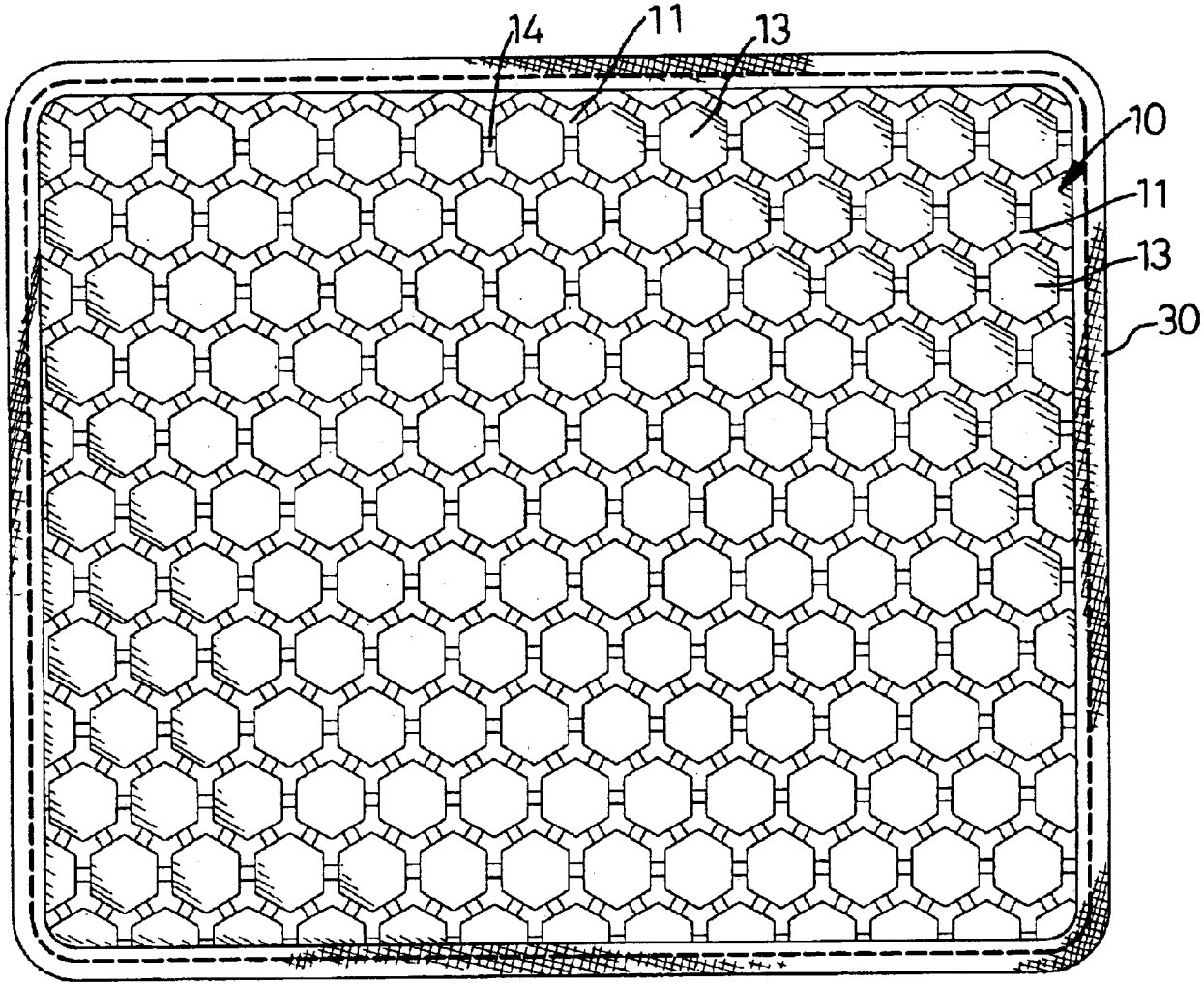
FIG. 2 is a top plan view of the personal cushion in FIG. 1.
Figure 4:
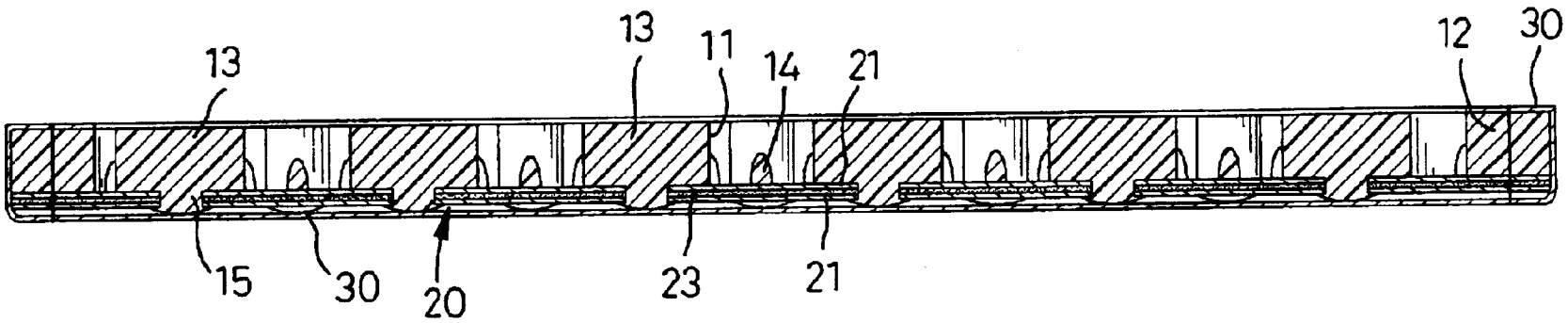
FIG. 4 is a cross-section side plan view of the personal cushion along line 4—4 in FIG. 3.

With reference to FIGS. 1, 2 and 4, a personal cushion in accordance with the present invention comprises a main body (100) and a covering layer (30).

The main body (100) has a top face (not numbered) and a bottom face (not numbered) and comprises a plastic layer (10) and an intermediate layer (20). The plastic layer (10) is formed by injection molding and penetrates the intermediate layer (20). Since the injection molding technology is conventional, redundant description of the injection molding is obviated here.

Figure 3:
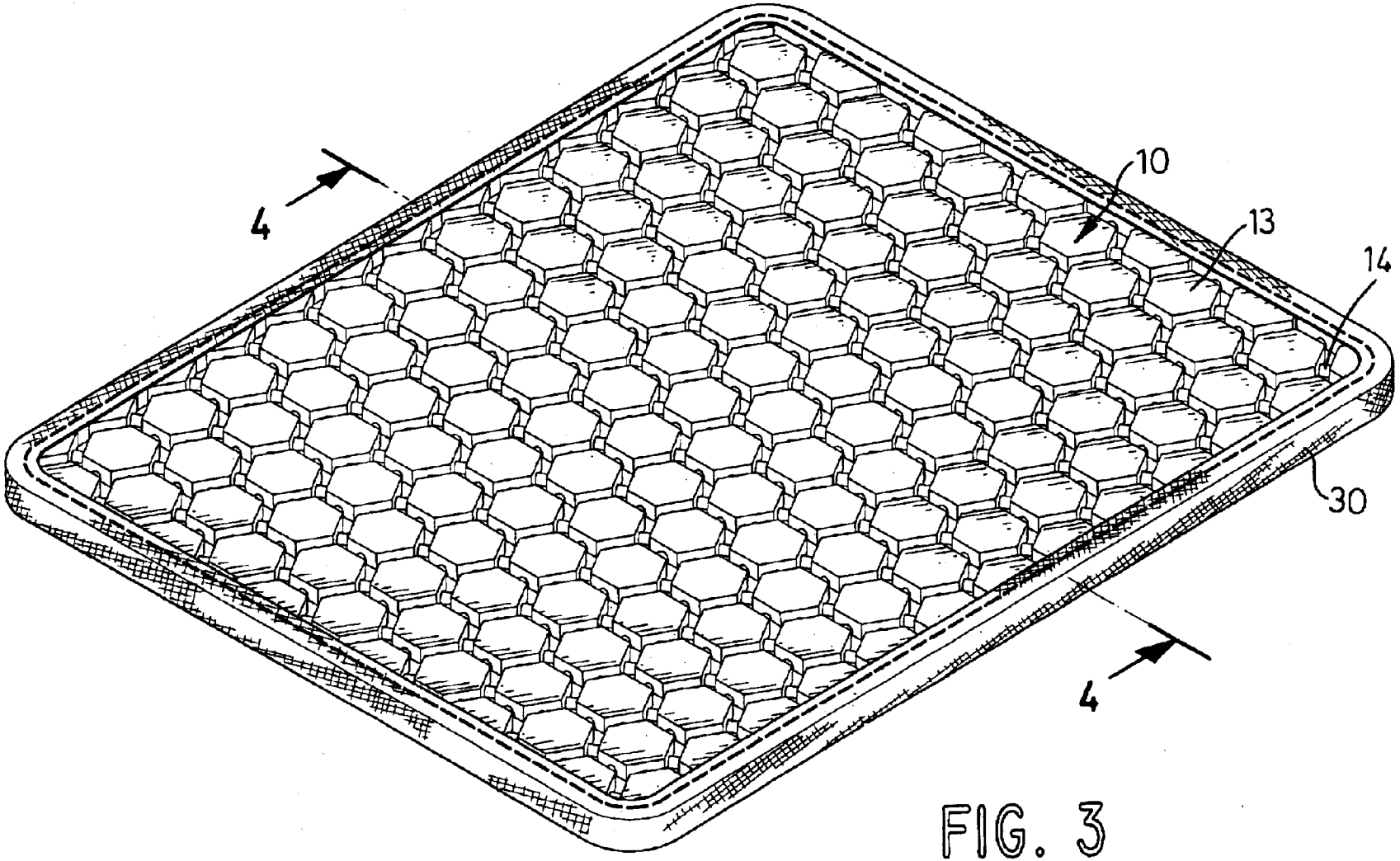
FIG. 3 is a perspective view of the personal cushion in FIG. 2.

With further reference to FIG. 3, the plastic layer (10) is made of biodegradable thermoplastic resilient material and has a framed edge (12) and multiple ventilating slots (11) defined through the plastic layer (10). With reference to FIGS. 1–4, the multiple ventilating slots (11) are arranged in a polygonal configuration, such as a hexagon in this embodiment, to define a hexagonal contacting block (13) with six sides by six ventilating slots (11). When the ventilating slots (11) sequentially communicate with each other, a rib (14) is formed from each side of each hexagonal contacting block (13) to the adjacent side of the corresponding hexagonal contacting block (13) to connect adjacent contacting blocks (13) together.

Moreover, each hexagonal contacting block (13) has a bottom face (not numbered) and a foot (15) protruding from the bottom face to penetrate the intermediate layer (20) to hold the plastic layer (10) and the intermediate layer (20) together.

The intermediate layer (20) is attached under the plastic layer (10) and is preferred to be composed of two fiber layers (21) and an active layer (23) between the two fiber layers (21). Each fiber layer (21) is made of artificial fiber or natural plant fiber, and the active layer (23) is made of ceramic powder or activated charcoal powder. Whereby, each layer (21, 23) of the intermediate layer (20) is permeable and is attached to the plastic layer (10) by liquid plastic molding material for the plastic layer (10) permeating the intermediate layer (20) at the feet (15) during injection molding. Optionally, multiple holes (not numbered) are defined in the intermediate layer (20) to allow the feet (15) of the contacting blocks (13) passing thorough instead of permeating through intermediate layer (20). However, periphery of the feet (15) still combines with intermediate layer (20) to keep the fiber layers (21) and the active layer (23) together.

The covering layer (30) with edges is the same shape as the main body (100), is made of cloth and larger than the main body (100). The covering layer (30) covers the bottom face of the main body (100), and the edges wrap around the edges of the main body (100), are folded for a neat appearance and are sewn to the framed edge (12) of the plastic layer (10).

Figure 5:
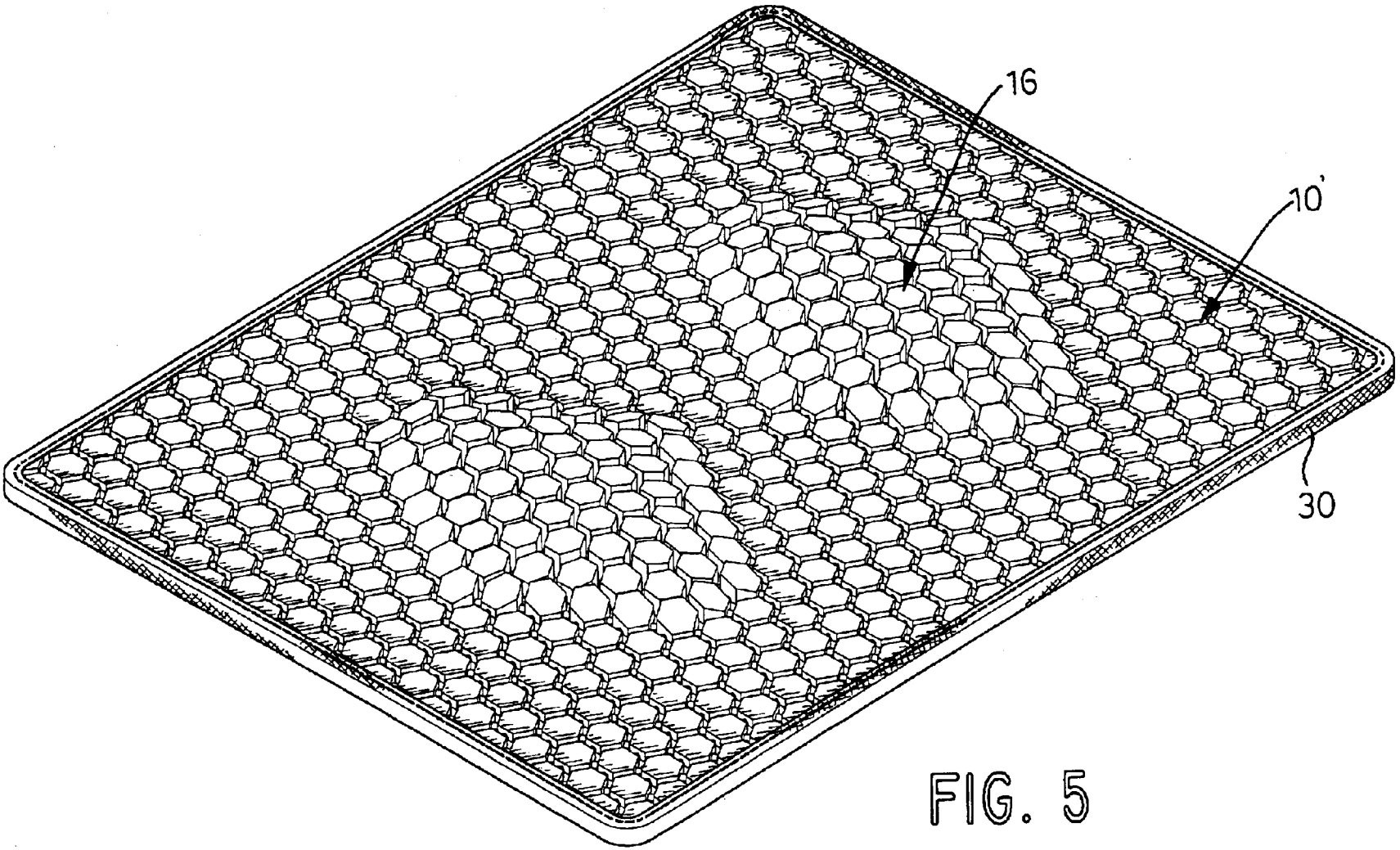
FIG. 5 is a perspective view of another embodiment of the personal cushion in accordance with the present invention.

With reference to FIG. 5, another embodiment of the personal cushion in accordance with the present invention further has multiple convex areas (16) formed on the top face of the main body i.e. formed on the plastic layer (10'). Additionally, the plastic layer (10') is designed to correspond to a person's shape to make the personal cushion more comfortable.

The personal cushion in accordance with the present invention has the following advantages:

1. The active layer (23) composed of activated charcoal or ceramic power of the intermediate layer (20) deodorizes and dehumidifies to prevent the cushion from being infested with bacteria and dust mites. Therefore, the personal cushion has deodorizing, dehumidifying and anti-mite protection capabilities.

2. Multiple ventilating slots (11) defined on the plastic layer (10) provide excellent ventilation to the personal cushion. Meanwhile, the intermediate layer (20) composed of the fiber layers (21) and the active layer (23) is also ventilated to prevent the accumulation of moisture.

3. The plastic layer (10) is made of resilient plastic material that has excellent restitution characteristics and is not easily permanently deformed as is stuffing material of artificial fiber and sponge in a conventional personal cushion.

4. The plastic layer (10) is made of biodegradable plastic material that readily decomposes after the personal cushion is discarded. Meanwhile, the covering layer (30) and the intermediate layer (20) are made of natural material that naturally decompose after a period of time. Therefore, the personal cushion in accordance with the present invention has fewer environmental problems than a conventional personal cushion after the personal cushions are discarded.

5. The personal cushion is easily produced since the combination of the main body (100) is achieve by permeating or penetrating liquid plastic molding material into the intermediate layer (20) when the plastic layer (10) is molded in one step. The personal cushion is completed by sewing the covering layer (30) to the main body (100). Manufacturing processes of the personal cushion are simple, and production cost of the personal cushion is low.

Although the invention has been explained in relation to its preferred embodiment, many other possible modifications and variations can be made without departing from the spirit and scope of the invention as hereinafter claimed.

What is claimed is:

1. A personal cushion comprising:

a main body (100) with a bottom face and a top face having a plastic layer (10) with edges and multiple ventilating slots (11) defined in the plastic layer (10); and an intermediate layer (20) attached under the plastic layer (10) and composed of at least two fiber layers (21) and at least one active layer (23) each laminated between two adjacent fiber layers (21); and a covering layer (30) covering the bottom face of the main body (100), wrapping around the edges of the plastic frame (10) and sewn to the plastic layer (10);

wherein the plastic layer (10) is made of thermoplastic resilient material and permeates the intermediate layer (20) to attach to the intermediate layer (20) when the plastic layer (10) is molded.

2. The personal cushion as claimed in claim 1, wherein the plastic layer (10) further has a framed edge (12) and the multiple ventilating slots (11) are defined within the framed edge (12);

wherein the ventilating slots (11) are arranged in a hexagonal configuration with six sides to define multiple hexagonal contacting blocks (13) between communicating ventilating slots (11);

wherein six ribs (14) are respectively formed from six sides of each hexagonal contacting block (13) and are respectively connected to six adjacent sides of six adjacent hexagonal contacting blocks (13), whereby, the contacting blocks (13) are combined together.

3. The personal cushion as claimed in claim 2, wherein the intermediate layer (20) has multiple holes defined in the intermediate layer (20); and each hexagonal contacting block (13) has a bottom face and a foot (15) protruding from the bottom face and corresponding to one of the multiple holes in the intermediate layer (20) to penetrate the corresponding hole of the intermediate layer (20).

4. The personal cushion as claimed in claim 1, wherein the intermediate layer (20) has two fiber layers (21) and one active layer (23) laminated between the two fiber layers (21);

wherein the active layer (23) contains activated charcoal.

5. The personal cushion as claimed in claim 1, wherein the intermediate layer (20) has two fiber layers (21) and one active layer (23) laminated between the two fiber layers (21);

wherein the active layer (23) contains ceramic powder.

* * * * *